US008943724B2

(12) United States Patent
Glass et al.

(10) Patent No.: US 8,943,724 B2
(45) Date of Patent: Feb. 3, 2015

(54) HANG TAG ASSEMBLY FOR HOLDING A GIFT CARD BACKER PANEL

(75) Inventors: Brett R. Glass, Overland Park, KS (US); Nicole E. Glass, Overland Park, KS (US)

(73) Assignee: Gift Card Impressions, LLC, Kansas City, MO (US)

( * ) Notice: Subject to any disclaimer, the term of this patent is extended or adjusted under 35 U.S.C. 154(b) by 0 days.

(21) Appl. No.: 13/429,308

(22) Filed: Mar. 23, 2012

(65) Prior Publication Data

US 2013/0074388 A1 Mar. 28, 2013

Related U.S. Application Data

(60) Provisional application No. 61/466,496, filed on Mar. 23, 2011.

(51) Int. Cl.

| | |
|---|---|
| ***G09F 3/10*** | (2006.01) |
| ***G09F 3/02*** | (2006.01) |
| ***G09F 3/14*** | (2006.01) |

(52) U.S. Cl.
CPC ... *G09F 3/02* (2013.01); *G09F 3/14* (2013.01)
USPC ..... 40/672; 40/661.09

(58) Field of Classification Search
USPC ..... 40/124.01, 661.06, 661.08, 661.09, 40/641, 672, 673; 248/214; 206/469, 119
See application file for complete search history.

(56) References Cited

U.S. PATENT DOCUMENTS

| | | | | |
|---|---|---|---|---|
| 5,975,302 | A * | 11/1999 | Young | 206/449 |
| 6,517,038 | B1 * | 2/2003 | Pomerantz | 248/214 |
| 7,225,570 | B2 * | 6/2007 | Windorski | 40/641 |
| 2003/0028439 | A1 * | 2/2003 | Cox et al. | 705/26 |
| 2003/0217949 | A1 * | 11/2003 | Schamante | 206/705 |

* cited by examiner

*Primary Examiner* — Joanne Silbermann
(74) *Attorney, Agent, or Firm* — Polsinelli PC

(57) ABSTRACT

A holder for receiving and holding a gift card includes hang tag panels that project upward from an upper margin of the main body of the holder, one or more of the hang tag panels being attached to and supporting a gift card backer panel for temporarily holding a gift card removably attached thereto.

16 Claims, 6 Drawing Sheets

HANG TAG ASSEMBLY FOR HOLDING A GIFT CARD BACKER PANEL

CROSS REFERENCE TO RELATED APPLICATIONS

This application claims the benefit of the prior filed, co-pending provisional application Ser. No. 61/466,496, filed Mar. 23, 2011.

BACKGROUND OF THE INVENTION

This invention relates generally to card holders and more particularly to a device for holding a transaction card, such as a gift card, already attached to a flat backer panel.

Transaction cards, stored value cards, or gift cards, as they are commonly called based upon their intended use, have become popular gifts. Gift cards typically comprise a stored value card whereby a certain cash equivalent value is encoded upon a magnetic strip applied to the surface of the card. This stored value may be determined by the vendor prior to packaging and display for sale or, more commonly, is selected at the point of sale by the purchaser and loaded by the cashier using a magnetic card reader/writer. While popular, gift cards are typically provided with a generic and impersonal design, typically identifying the associated merchant for which the card may be used to purchase merchandise, and therefore are not personalized in view of the intended recipient.

What is needed, therefore, is a gift card holder that provides graphical and mechanical enhancements to entertain the gift card recipient and add value to the gift. What is also needed is a means to assemble a gift card backer panel to a separately manufactured gift card holder so that the backer panel bearing a gift card and the gift card holder may be displayed and sold as a unit while taking up no more space on a display stand than a gift card backer panel displayed alone.

BRIEF DESCRIPTION OF THE INVENTION

The purpose of this invention is to provide a holder for receiving and holding a gift card. The holder includes hang tag panels that project upward from an upper margin of the main body of the holder. One or more of the hang tag panels is provided with an adhesive on the inside surface for attaching the hang tag panels to a gift card backer panel, including a gift card backer panel of the type commonly known in the prior art. The upper portion of the backer panel is received between the hang tag panels, typically in a manner so that the display peg hole in the backer panel is in alignment with the display peg holes in the hang tag panels. Prior to gifting, the hang tag panels and backer panel are removed from the gift card holder by tearing along a perforation line dividing the hang tag panels from the holder main body. The gift card is removed from the backer panel and installed upon or inside in the holder and the holder is presented to the gift recipient.

A hang tag assembly for a gift card holder may comprise a first hang tag panel and a second hang tag panel, the first hang tag panel and the second hang tag panel defined from one another by a fold line and provided with adhesive therebetween upon an inside surface of at least one of the hang tag panels. One or more adhesive bearing tabs projects downward from one of the hang tag panels to attach to a gift card holder structure to be suspended therefrom. A backer panel is inserted between the first and second hang tag panels and secured therebetween by the adhesive upon one or more of the inside surfaces of the hang tag panels. A gift card is typically attached via removable adhesive to a surface of the backer panel.

Other advantages of the invention will become apparent from the following description taken in connection with the accompanying drawings, wherein is set forth by way of illustration and example an embodiment of the present invention.

DETAILED DESCRIPTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
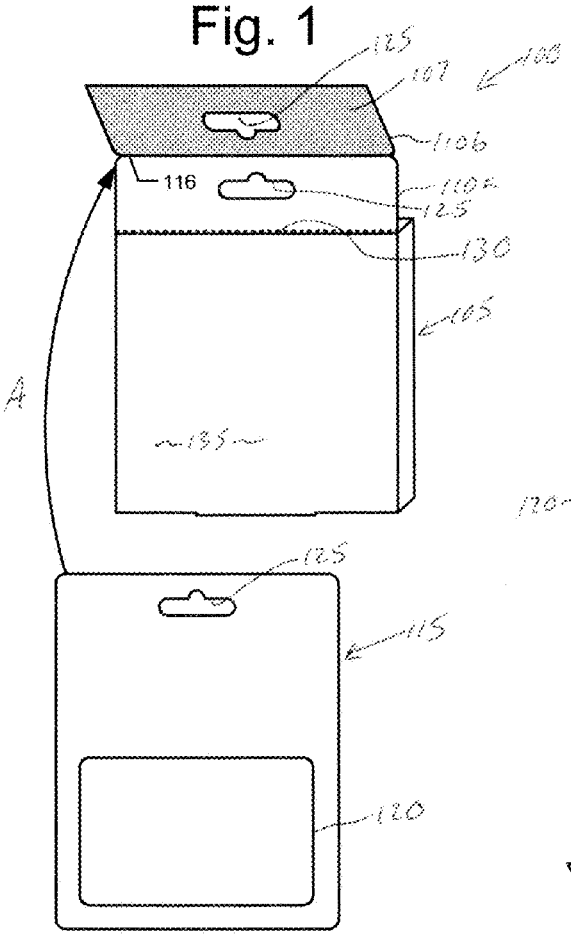
FIG. 1 is a front view of a gift card holder with the hang tag panels in a open position to receive a gift card backer panel.

With reference to the figures, FIGS. 1 through 4 illustrate an embodiment of a gift card holder 100. The main body 105 of the holder typically comprises six outer walls surrounding an interior space. The main body 105 is typically substantially rectangular in cross section and may be used to house a sound producing circuit or other elements that may be installed within, on, or otherwise associated with the holder 100. Hang tag panels 110*a* and 110*b* (collectively, 110) are defined from one another by a fold line 116 and project upward from an upper margin of the main body 105 and one or more of the hang tag panels 110 is provided with an adhesive 107 on the inside surface thereof for attaching the hang tag panels 110 to a gift card backer panel 115, including a gift card backer panel of the type commonly known in the prior art. FIG. 1 is a front perspective view of the gift card holder 100 with the hang tag panels 110*a* and 110*b* in an open position to receive a backer panel 115. The backer panel 115 typically comprises cardboard or card stock or the like and provides a surface, as illustrated herein the front surface, removable attachment of a transaction card such as a gift card 120.

Figure 2:
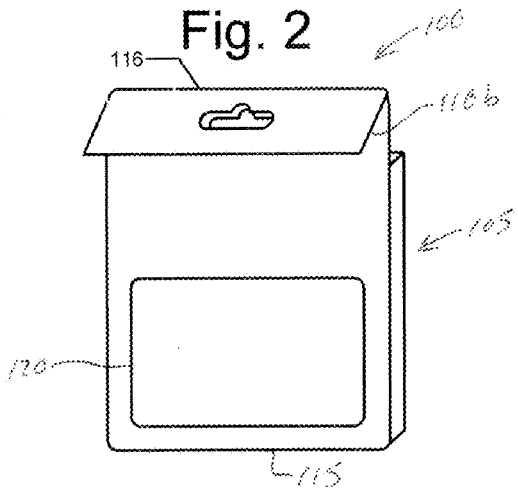
FIG. 2 is a front view of the holder of FIG. 1 showing the hang tag panels partially closed.
Figure 3:
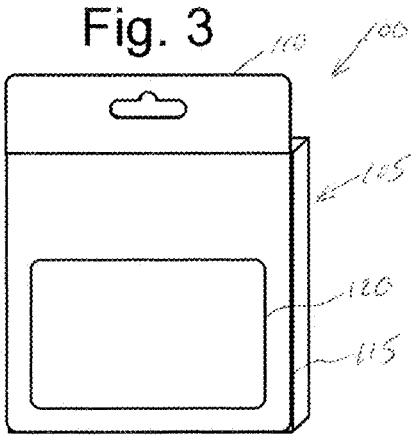
FIG. 3 is a front view of the holder of the previous figures showing a gift card backer panel installed between the hang tag panels.

The backer panel 115 is inserted in between the hang tag panels 110, as indicated by arrow A in FIG. 1, which are then closed upon the backer panel 115 until the adhesive 107 on the inside surface of one or both hang tag panels 110 contacts and adheres to the backer panel 115 to thereby secure the backer panel 115 between the hang tag panels 110 and to the holder 100. FIG. 2 is a front perspective view of the holder 100 of FIG. 1 showing the backer panel 115 in position between the hang tag panels 110 and the hang tag panels 110 partially closed. The upper portion of the backer panel 115 is received between the hang tag panels 110, typically in a manner so that the display peg hole 125 in the backer panel 115 is in alignment with the display peg holes 125 in the hang tag panels 110 as shown in FIG. 3. FIG. 3 is a front view of the holder 100 showing a gift card backer panel 115 installed between the hang tag panels 110.

Figure 4:
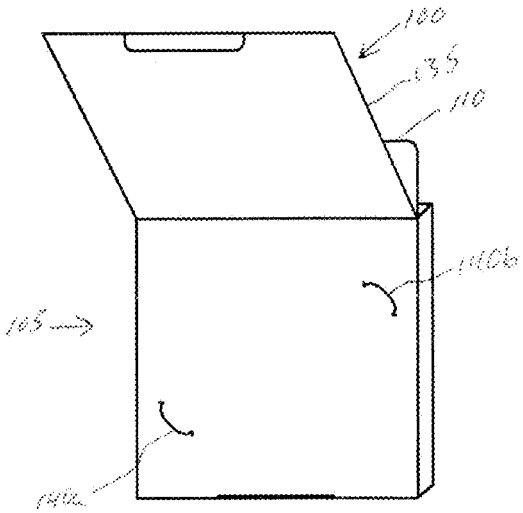
FIG. 4 is a front view of a gift card holder showing the cover of the holder in an open position to reveal the card holder slits.

Prior to gifting (giving the holder 100 and gift card 125 thereon to a gift recipient), the hang tag panels 110 and backer panel 115 are removed from the gift card holder 100 by tearing along a perforation line 130 dividing the hang tag panels 110 from the cover flap 135 of the holder main body 105. The gift card 120 is removed from the backer panel 115 and installed upon or inside in the holder 100 and the holder 100 (with hang tag panels 110 and backer panel 115 detached) is presented to the gift recipient. FIG. 4 is a front perspective view of the gift card holder 100 showing the cover flap 135 of the holder in an open position to reveal the diagonally opposed card holder slits 140*a* and 140*b* (collectively, 140). In this particular embodiment of a gift card holder 100, diagonally opposing corners of the gift card 120 are inserted into the slits 140 after the gift card 120 is removed from the backer panel 115.

Figure 5:
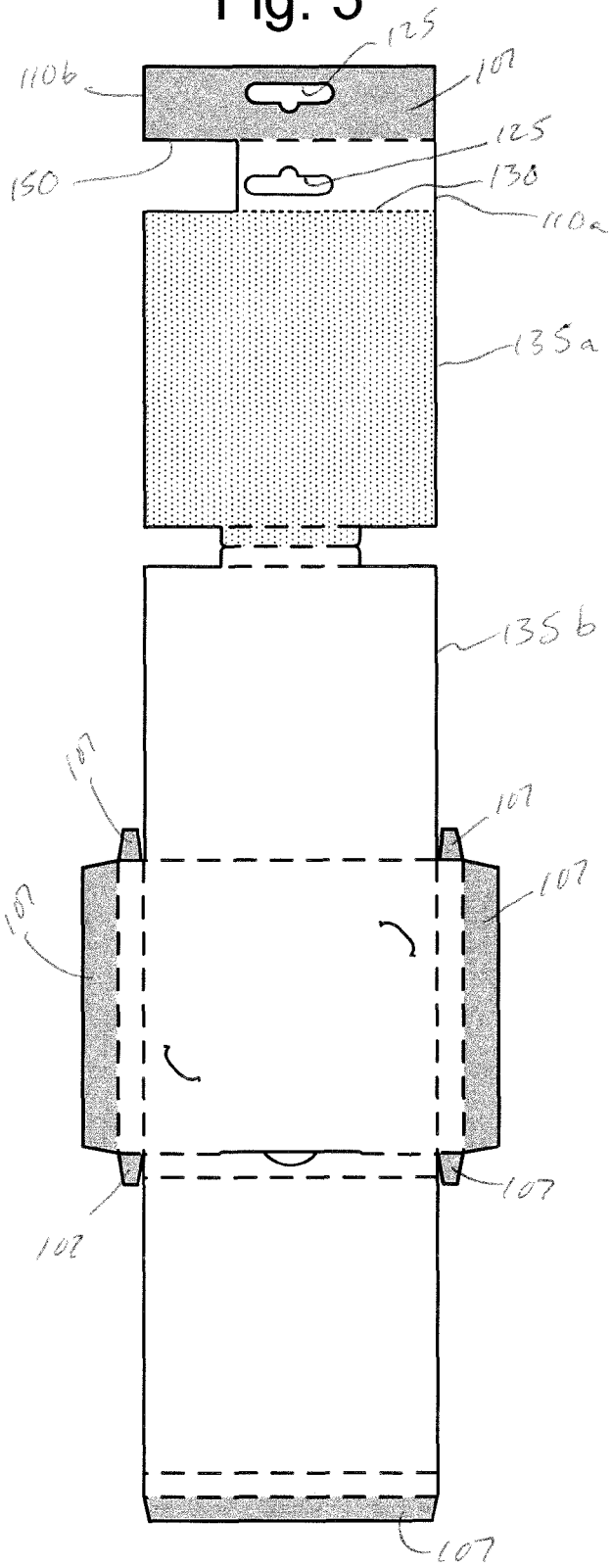
FIG. 5 is a plan view of a gift card holder prior to assembly.

FIG. 5 is a plan view of a gift card holder 100 (minus backer panel 115), typically die cut from card stock, and prior to assembly. As shown, one of the hang tag panels 110*a*, typically the hang tag panel that faces rearward when the holder 100 is mounted on a display peg, may be provided with a cutout or notch 150 so that a bar code or other indicia on an upper, rearward facing surface of the backer panel 115 may remain uncovered (as shown in other embodiments in FIGS. 10, 12 and 15) after installation of the backer panel 115 between the hang tag panels 110.

Figure 6:
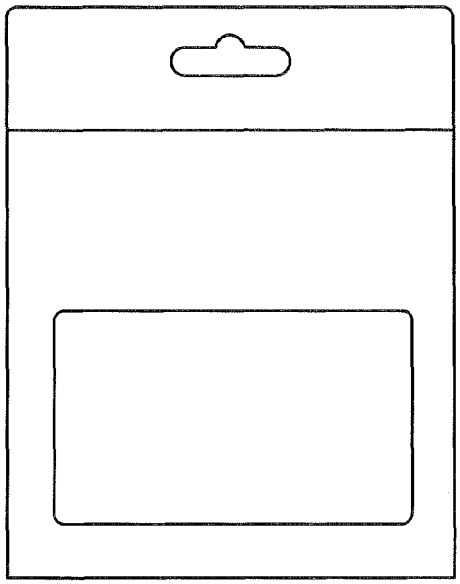
FIG. 6 is a front view of a gift card holder.
Figure 8:
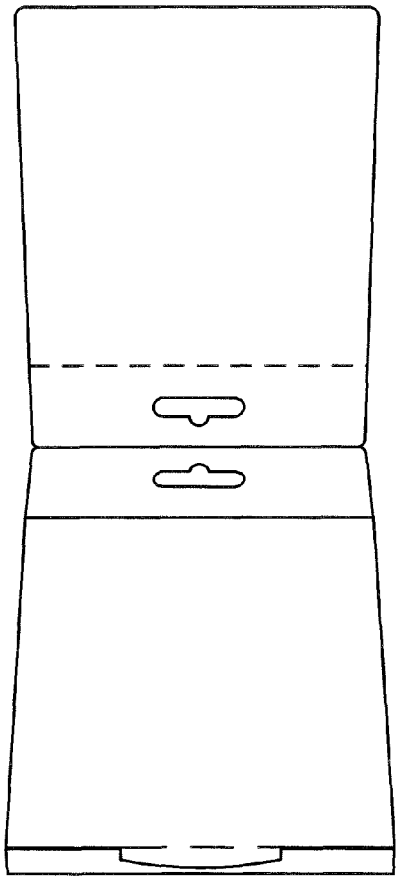
FIG. 8 is a perspective view of a gift card holder showing an attached gift card backer panel attached to the front hang tag panel and lifted away from the main holder body.
Figure 7:
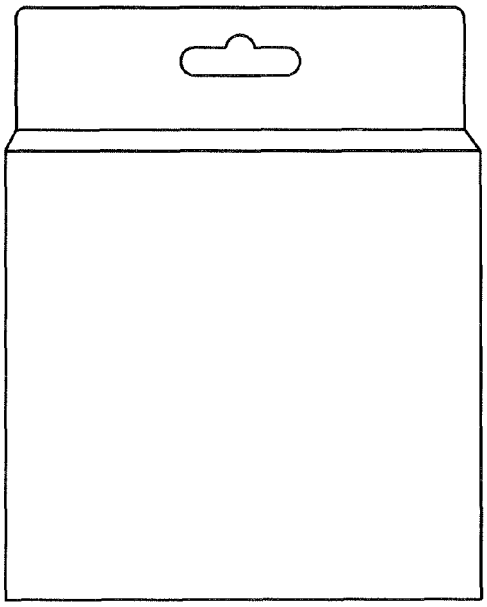
FIG. 7 is a rear view of the gift card holder of FIG. 6.

FIG. 6 is a front view of a gift card holder. FIG. 7 is a rear view of the gift card holder of FIG. 6. FIG. 8 is a perspective view of the gift card holder of FIGS. 6 and 7 showing an attached gift card backer panel attached to the front hang tag panel and lifted away from the main holder body.

Figure 9:
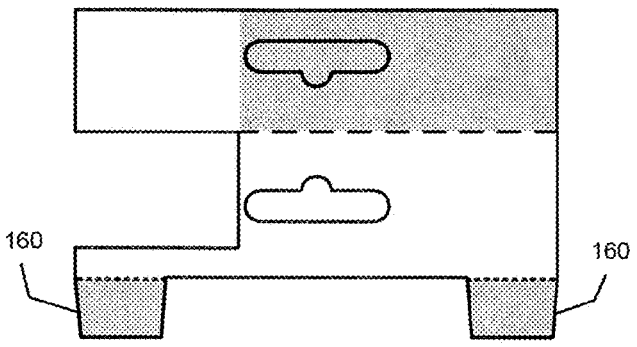
FIG. 9 is a front view of a hang tag assembly that includes tabs for adhering to a structure to be hung from a display hook by the hang tag assembly.
Figure 10:
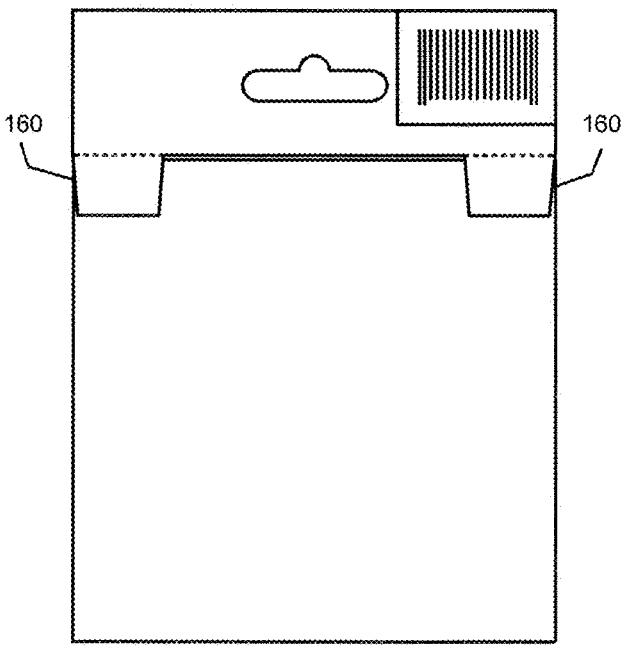
FIG. 10 is a rear view of a hang tag assembly showing the tabs attached to a structure such as a gift card holder.

FIG. 9 is a front view of a hang tag assembly that includes tabs 160 for adhering to a structure to be hung from a display hook by the hang tag assembly. In this embodiment, unlike the embodiment shown in FIG. 5, for example, the hang tag panels are not integral with the gift card holder structure but rather are provided as a separate unit that may be attached via adhesive tabs 160 to any structure suitable for hanging from a display peg. As shown in FIG. 9, the tabs 160 project downward from the hang tag panel that typically faces rear ward when the assembly is hung for display upon a display peg. FIG. 10 is a rear view of a hang tag assembly showing the adhesive tabs 160 attached to a structure such as a gift card holder. The hang tag assembly, including tabs 160, are typically formed from card stock or other suitable materials. Pressure sensitive adhesive is applied during manufacture of the assembly to the inside surface of at least one of the hang tag panels and also to the surfaces of the tabs 160 intended for attachment to a structure suspended therefrom.

Figure 11:
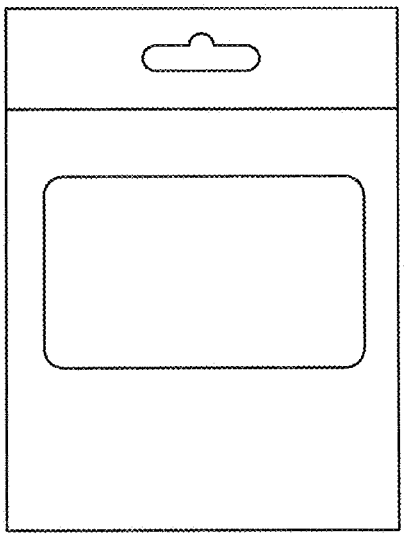
FIG. 11 is a front view of a hang tag assembly attached to a gift card holder.
Figure 12:
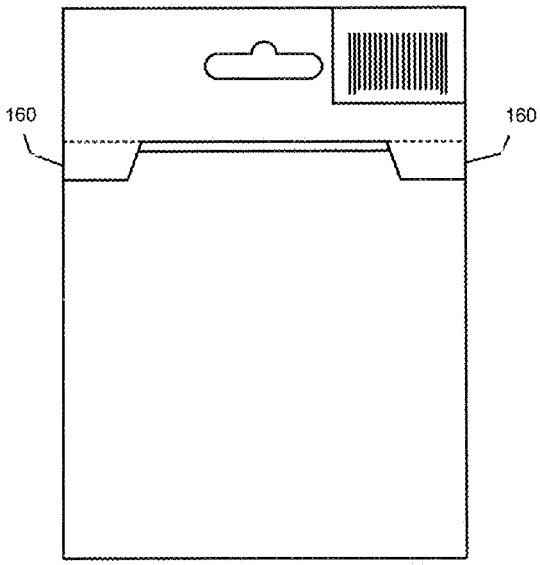
FIG. 12 is a rear view of a hang tag assembly attached via the adhesive tabs to a gift card holder.
Figure 13:
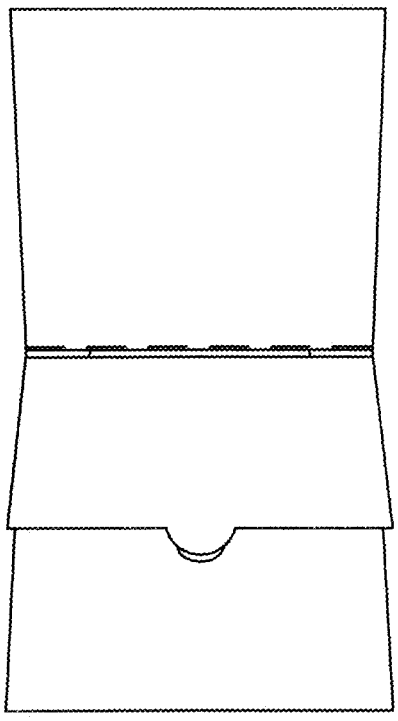
FIG. 13 is a front perspective view of the holder of FIGS. 11 and 12 showing the gift card backer panel lifted from the holder main body.

FIG. 11 is a front view of a hang tag assembly attached to a gift card holder. FIG. 12 is a rear view of a hang tag assembly attached via the adhesive tabs 160 to a gift card holder. The rearward surfaces of the tabs 160 are shown, the forward surfaces of the tabs 160 being attached to the rearward surface of the holder main body. FIG. 13 is a front perspective view of the holder of FIGS. 11 and 12 showing the gift card backer panel lifted from the holder main body. A portion of the forward surfaces tabs 160 are visible in the space between the backer panel and the top edge of the holder main body.

Figure 14:
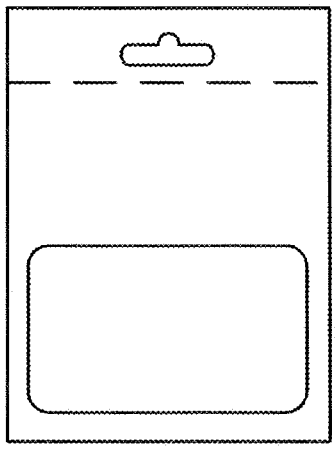
FIG. 14 is a front view of a hang tag assembly attached to a gift card holder.
Figure 16:
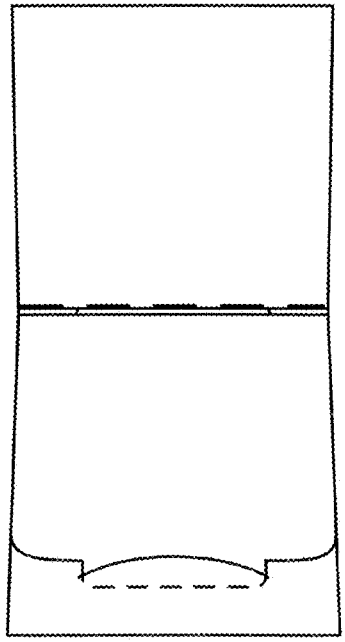
FIG. 16 is a front perspective view of the holder of FIGS. 14 and 15 showing the gift card backer panel lifted from the holder main body.
Figure 15:
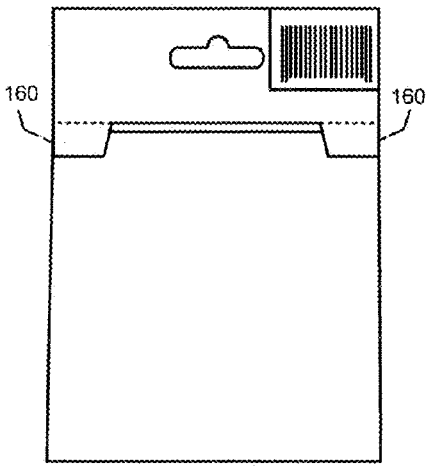
FIG. 15 is a rear view of the hang tag assembly and holder of FIG. 14 showing the hang tag assembly attached to the holder via adhesive tabs.

FIG. 14 is a front view of a hang tag assembly attached to a gift card holder. FIG. 15 is a rear view of the hang tag assembly and holder of FIG. 14 showing the hang tag assembly attached to the holder via adhesive tabs 160 and also showing the bar code of the back panel visible through the cutout in the rearward facing hang tag panel. FIG. 16 is a front perspective view of the holder of FIGS. 14 and 15 showing the gift card backer panel lifted from the holder main body.

Note that drawings are not to scale or to relative scale but are representative of aspects of one or more embodiments of the present invention.

Having thus described the invention, what is claimed as new and desired to be secured by Letters Patent is:

1. A transaction card holder assembly comprising:

a first hang tag panel engaged to a second hang tag panel, where the first hang tag panel and the second hang tag panel defined from one another by a fold line along a first edge of the second hang tag;

an adhesive upon an inside surface of the first hang tag panel;

a transaction card holder removably engaged to a second edge of the second hang tag panel, wherein the transaction card holder to receive a transaction card;

one or more adhesive bearing tabs extending from the second edge of the second hang tag panel to engage the transaction card holder; and a backer panel disposed between the first hang tag panel and the second hang tag panel and engaged to the first hang tag panel by the adhesive and wherein the transaction card is removably engaged to the backer panel.

2. The transaction card holder assembly of claim 1, wherein the first hang tag panel, the second hang tag panel, and the transaction card holder comprises as least one of cardboard or card stock.

3. The transaction card holder assembly of claim 1, wherein the transaction card holder receives the transaction card, removed from the backer panel, in one or more card holder slits for holding and displaying the transaction card.

4. The transaction card holder assembly of claim 1, wherein the transaction card comprises a gift card.

5. The transaction card holder assembly of claim 4, wherein the transaction card holder is generally rectangular in cross-section.

6. The transaction card holder assembly of claim 1, wherein the second hang tag panel comprises a display peg hole and a notch for accessing a portion of the backer panel when disposed between the first hang tag panel and the second hang tag panel.

7. The transaction card holder assembly of claim 1, wherein the transaction card holder is separate and distinct from the backer panel.

8. The transaction card holder assembly of claim 1, wherein the second edge of the second hang tag panel is removably engaged to the transaction card holder by a series of perforations.

9. A transaction card holder assembly comprising:

a removable hang tag assembly comprising a first hang tag panel hingedly engagedly to a second hang tag panel;

a transaction card holder to hold and display a transaction card;

a backer panel removably engaged to the transaction card;

wherein the backer panel is engaged to the hang tag assembly;

wherein the hang tag assembly is removably engaged to the transaction card holder;

wherein the transaction card is disposed in the transaction card holder after removal of the hang tag assembly; and wherein the second hang tag panel comprises one or more adhesive bearing tabs extending from an edge of the second hang tag panel opposite the first hang tag panel for engaging the transaction card holder.

10. The transaction card holder assembly of claim 9, wherein the first hang tag panel, the second hang tag panel, and the transaction card holder comprises cardboard or card stock.

11. The transaction card holder assembly of claim 9, wherein the transaction card holder comprises one or more card holder slits for holding the transaction card removed from the backer panel.

12. The transaction card holder assembly of claim 9, wherein the transaction card comprises a gift card.

13. The transaction card holder assembly of claim 12, wherein the transaction card holder is generally rectangular in cross-section.

14. The transaction card holder assembly of claim 9, wherein the second hang tag panel comprises a display peg hole and a notch for accessing a portion of the backer panel when disposed between the first hang tag panel and the second hang tag panel.

15. The transaction card holder assembly of claim 9, wherein the transaction card holder is separate and distinct from the backer panel.

16. The transaction card holder assembly of claim 9, wherein the hang tag assembly is removably engaged to the transaction card holder by a series of perforations.

* * * * *